US005450889A

United States Patent [19]

Jones et al.

[11] Patent Number: 5,450,889

[45] Date of Patent: Sep. 19, 1995

[54] CURTAIN DOOR ASSEMBLY

[76] Inventors: Betty M. R. Jones; Malcolm Jones, both of P. O. Box 90, Madison, Ga. 30650

[21] Appl. No.: 228,702

[22] Filed: Apr. 18, 1994

[51] Int. Cl.[6] ..... A47H 1/00

[52] U.S. Cl. ..... 160/38; 160/330; 70/212

[58] Field of Search ..... 160/330, 38, 349.2, 160/199, 290.1, 268.1, 19; 70/212; 292/66, 68, 205

[56] References Cited

U.S. PATENT DOCUMENTS

| | | | |
|---|---|---|---|
| 3,891,253 | 6/1975 | Revell | 292/59 |
| 4,102,353 | 7/1978 | Pugliese | 160/349.2 X |
| 4,572,862 | 3/1986 | Rejc | 160/199 |

FOREIGN PATENT DOCUMENTS

| | | | |
|---|---|---|---|
| 549738 | 8/1956 | Belgium | 160/330 |
| 1388054 | 12/1963 | France | 160/330 |
| 899075 | 6/1962 | United Kingdom | 160/330 |

OTHER PUBLICATIONS

Flexion Advertisement (no date).

*Primary Examiner*—Blair M. Johnson

*Attorney, Agent, or Firm*—Hopkins & Thomas

[57] ABSTRACT

A door curtain assembly (10) for temporarily closing the door opening of a loading dock doorway for a warehouse, or similar industrial building, including a framework (20) mounted within the door jamb of the doorway. A door curtain (42) is movably mounted to the framework (20) and is formed from a durable, porous material that enables light and air to readily pass therethrough, but which retards the passage of insects, etc. through the open door of a warehouse. The door curtain (42) is slidably mounted on a curtain rod (66) and is movable across the width of the door opening to open and close the door opening. A locking handle (96) is provided along one side edge (49) of the door curtain (42) for locking the door curtain (42) in its closed position for enclosing the door opening.

12 Claims, 6 Drawing Sheets

CURTAIN DOOR ASSEMBLY

FIELD OF THE INVENTION

The present invention relates in general to curtain door assemblies. In particular, the present invention relates to a curtain door assembly for closing a door opening of a warehouse, factory, or similar facility and which is constructed of a porous material that enables the passage of light and air therethrough, but which prevents insects, birds, people, and the like from passing therethrough.

BACKGROUND OF THE INVENTION

Most warehouses, storage facilities, manufacturing plants, and other industrial buildings generally are large metal and concrete buildings which have a large inside working area. Such buildings typically are not air conditioned, as the doors of these buildings are frequently opened to permit access for the shipment and receipt of goods, and therefore it is simply too expensive to air condition the entire building. Consequently, such buildings generally have limited or poor ventilation without the dock doors open and can become very uncomfortable, especially in warmer climates and during the warmer summer months of the year, due to this lack of ventilation. As a result, these buildings can become unbearably hot, creating conditions that are almost unbearable for workers.

The most obvious solution to this problem has simply been to keep the loading dock doors open so that fans inside the warehouse can draw a flow of air into and through the warehouse. The problem with leaving the doors open is, however, that insects, birds, and other pests can fly or crawl into the warehouse through the open doors. Such an infestation of insects violates county or city health ordinances and regulations, which often require that the warehouse doors be kept closed for insect control and sanitary reasons. Additionally, with the doors left open, there is greater potential for pilferage by people outside the warehouse and by employees. As a result, it is generally necessary to keep the loading dock doors of warehouses, manufacturing facilities, and other similar buildings closed to cut off access through the warehouse doors to keep insect infestation down and to reduce the incidence of pilferage. With the doors shut, the airflow through the warehouse also is shut off, reducing the ventilation inside the warehouse.

Attempts have been made to develop hanging curtains that temporarily or partially close off the dock doors of a warehouse. Such curtains typically are not, however, lockable so as to securely close or seal the doorway, and if these curtains do seal the doorway, they generally are not easy to open and close. Thus, the use of these curtains can limit or reduce access to the warehouse.

Accordingly, it can be seen that a need exists for a means for enclosing the dock door openings of warehouses, manufacturing plants, and similar industrial buildings to prevent access to the warehouse through the dock door opening by insects, birds, and by people to control insect infestation and reduce the potential of pilferage, but which enables a flow of air to be drawn through the dock door opening to ensure adequate ventilation in the warehouse and which is easy to open and securely close.

SUMMARY OF THE INVENTION

Briefly described, the present invention comprises a curtain door assembly for use in warehouses, factories, and similar industrial buildings for closing the door openings of the loading dock doors of the building.

The curtain door assembly generally includes a framework having first and second angle brackets mounted to the vertical sides of the door jamb, extending partially along the length thereof. Each angle bracket generally is L-shaped and has a substantially flat longitudinal portion bolted to the vertical sides of the door jamb, and a lateral portion oriented approximately at a 90° angle from the longitudinal portion, projecting inwardly, away from the sides of the door jamb. An upper plate is mounted to the header of the door jamb, spaced above the angle brackets and extending across the width of the door opening. The upper plate is generally a substantially rectangularly shaped plate having a pair of spaced tracks formed along its longitudinal side edges, and is mounted to the header of the door jamb by fasteners such as screws or bolts.

A curtain is mounted to the framework and functions as a means for enclosing the door opening of the doorway. The door curtain generally comprises a porous sheet of material such as a mesh or screen formed from plastic or similar material that enables light and air to pass through the curtain, but which retards the passage of insects and other pests, and people through the door opening. The door curtain generally is rectangularly shaped and is sized to fit the door opening. The door curtain has a first or stationary side edge along which a mounting plate is positioned. The mounting plate is attached to the lateral portion of the first angle bracket of the framework with the first side edge of the curtain sandwiched therebetween to attach the first side edge to the framework. The curtain also includes a second or closure side edge spaced from the first side edge and having a curtain bracket attached thereto, and a lower or bottom edge and an upper or top edge. A series of eyes are affixed to the door curtain along its top edge.

A curtain rod is mounted above the door curtain, supported on the upper ends of the first and second angle brackets of the framework, and extends laterally across the width of the door opening from the first side edge to the second side edge thereof. A series of curtain hooks are movably mounted on the curtain rod. Each curtain hook includes a curved, lower hook portion that is received through an eye affixed to the top edge of the door curtain, and an upper C-shaped portion received about the curtain rod. A pair of rollers positioned about the upper portion of each curtain hook and engage and roll along the curtain rod to move the door curtain across the door opening.

Valances are mounted to the tracks of the upper plate of the framework on the inside and outside of the door opening. Each valance typically is a curved plate formed from a rigid plastic material, and has a circularly shaped connector formed along an upper edge. The connectors are received within the tracks of the framework upper plate to mount the valances to the upper plate. Each valance extends downwardly from the upper plate, slightly overlapping the upper edge of the door curtain and curving inwardly toward engagement with the door curtain to cover and seal the space above the top edge of the door curtain.

A locking means for locking the door curtain in a closed position extended across the door opening is provided along the second or closure side edge of the door curtain. The locking means includes a substantially L-shaped curtain lock plate mounted along the second side edge of the door curtain. The curtain lock plate has a vertical portion and a horizontally oriented lower flange that projects laterally from the vertical portion and has a lock opening formed therethrough. A handle is rotatably mounted to the curtain lock plate and curtain bracket, extending partially therethrough. A handle lock plate is mountable to the curtain lock plate and has a handle opening formed therethrough, through which a proximal end of the handle is received, and further includes a lock opening that becomes aligned with the lock opening of the lower flange of the curtain lock plate when the handle lock plate is mounted to the curtain lock plate. A locking means such as a padlock or similar means can be inserted through the aligned lock openings to lock the handle in its closed and locked position.

A sweep is mounted to the lower or bottom end of the door curtain. The sweep generally is formed from a resilient flexible material such as a polyvinyl cloth or a rubber material and extends downwardly from the bottom edge of the door curtain a distance sufficient to engage and slightly overlap the floor of the door opening so as to seal the bottom edge of the door curtain.

Various objects and advantages of the present invention will become apparent upon reading the following specification when taken in conjunction with the accompanying drawings.

DETAILED DESCRIPTION

Figure 1:
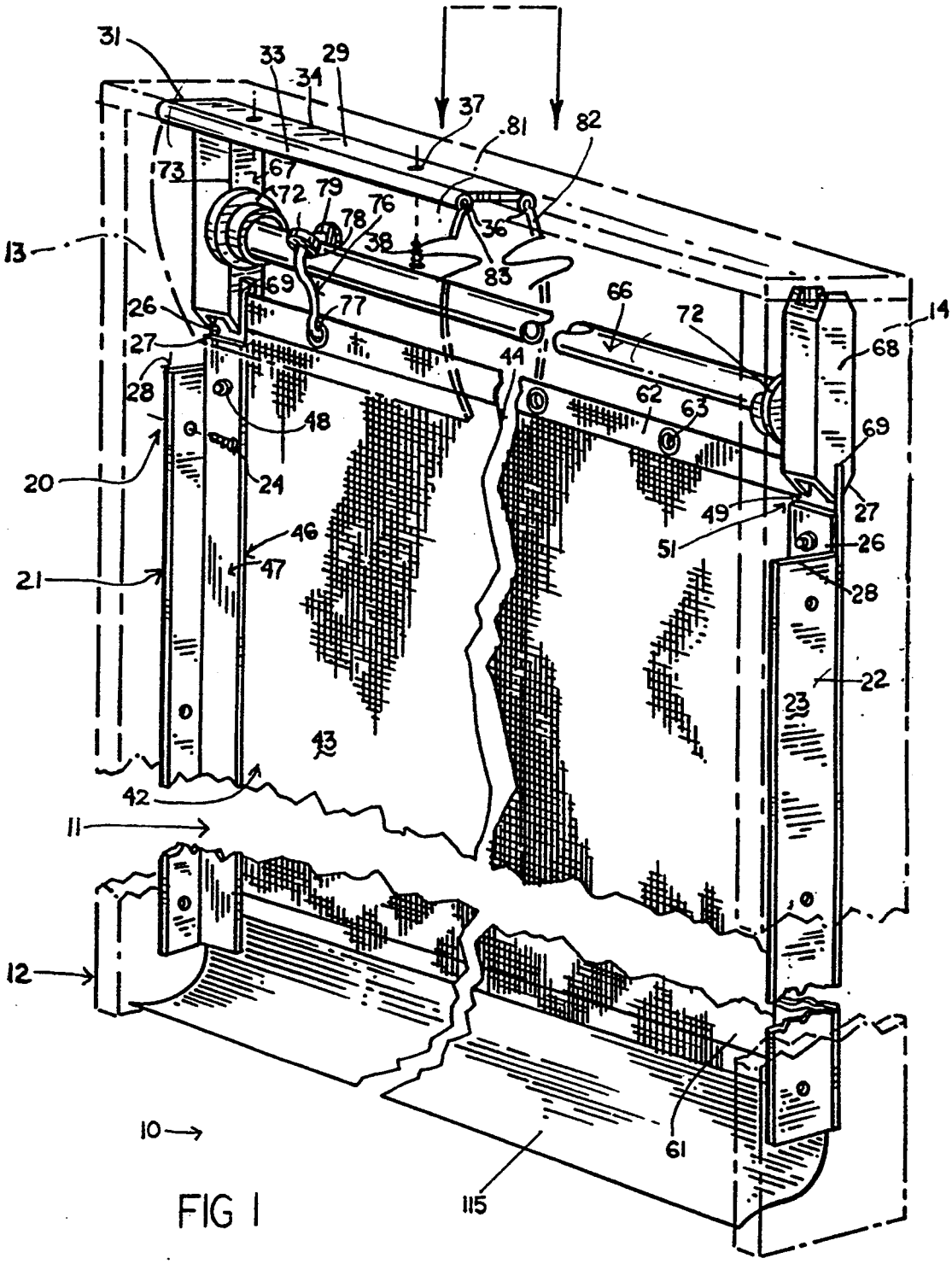
FIG 1 is a perspective illustration of the curtain door assembly mounted in a door frame with portions broken away for clarity.

Referring now to the drawings in greater detail in which like numerals indicate like parts throughout the several views, FIG. 1 illustrates a door curtain assembly 10 for enclosing a door opening 11 of a loading dock door or bay of a warehouse, manufacturing plant, or similar building. The door opening 11 is defined by a substantially rectangularly shaped door jamb or frame 12 (shown in phantom lines). The door jamb 12 includes a first vertical side portion 13, a second vertical side portion 14 opposed and extending parallel to the first side portion 13. A header 16 extends horizontally between the first and second side portions 13 and 14 at the upper portion of the door opening.

As shown in FIGS. 1 and 2, the door curtain assembly 10 includes a framework 20 that is mounted within the door jamb 12. The framework includes a first angle bracket 21 mounted to the first side 13 of the door jamb 12 and a second angle bracket 22 mounted to the second side 14 of the door jamb. Each angle bracket typically is formed from aluminum or a similar material and is of a length substantially less than the height of the sides of the door jamb. As FIGS. 1 and 3 illustrate, each of the angle brackets 21 and 22 has a substantially L-shaped configuration and includes a longitudinal portion 23 that is laid flat against the surface of the first and second sides of the door jamb, extending an intermediate distance therealong. The longitudinal portions are secured to the first and second sides of the door jamb by fasteners 24 such as screws, bolts, or similar means. Each angle bracket further includes a lateral portion 26 oriented at right angles to longitudinal portions 23 and projecting away from the first and second sides of the door jamb towards the center of the door opening 11. As FIG. 1 illustrates, the lateral portions of the first and second angle brackets are of a length slightly greater than the length of the longitudinal portions 23 such that the upper edges 27 of lateral portions 26 extend above the upper edges 28 of longitudinal portions 23.

Figure 4:
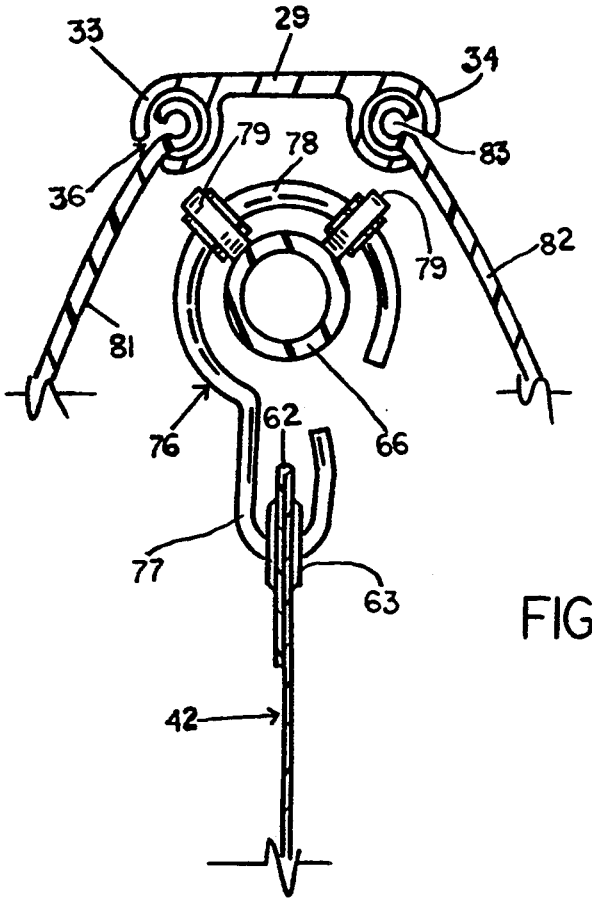
FIG. 4 is an end view taken in cross-section illustrating the upper portion of the door curtain attached to the curtain rod and covered by the valances.

The framework also includes an upper plate 29 mounted to the header 16. The upper plate 29 generally is a substantially rectangularly shaped plate formed from aluminum or similar material and having a length approximately equivalent to the length of the header. The upper plate has a pair of end edges 31 that abut the first and second sides 13 and 14 of the door jamb and a pair of parallel longitudinal side edges 33 and 34. As shown in FIGS. 1 and 4, each of side edges 33 and 34 of the upper plate has a substantially C-shaped track or groove 36 formed therealong. Three mounting holes 37 (FIG. 1) are formed along the length of the upper plate 29, one at the center and one one-fourth of the distance back from each jamb, through which fasteners 38 are inserted to secure the upper plate to the header of the door jamb.

Figure 2B:
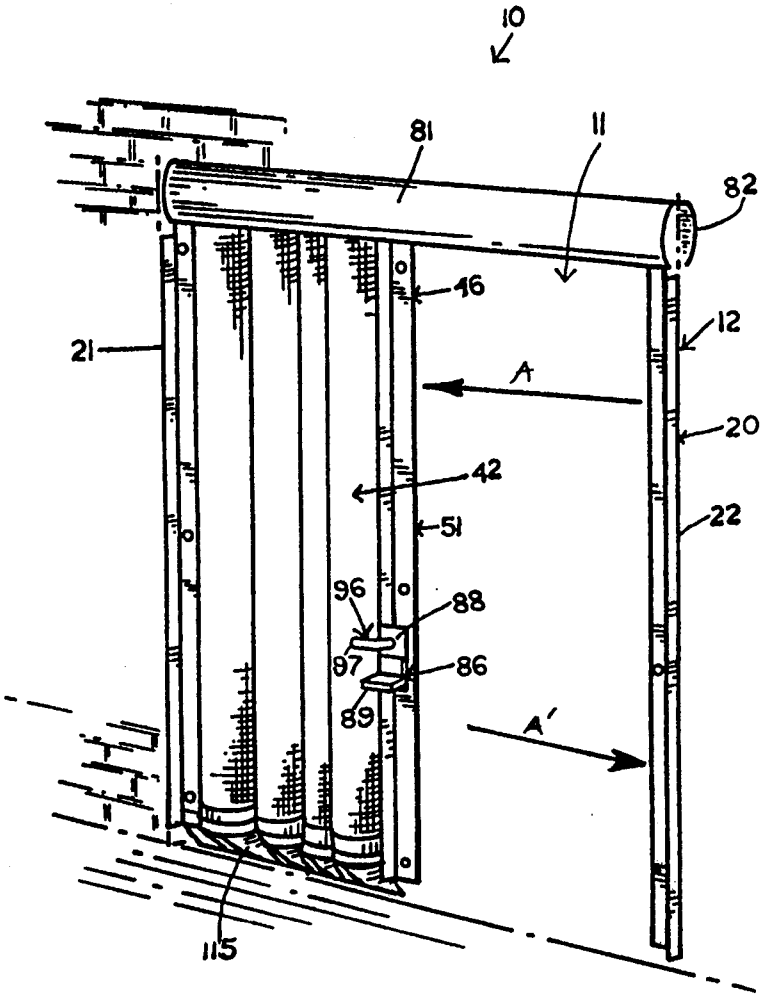
FIG. 2B is a perspective illustration of the door curtain assembly being opened.
Figure 2A:
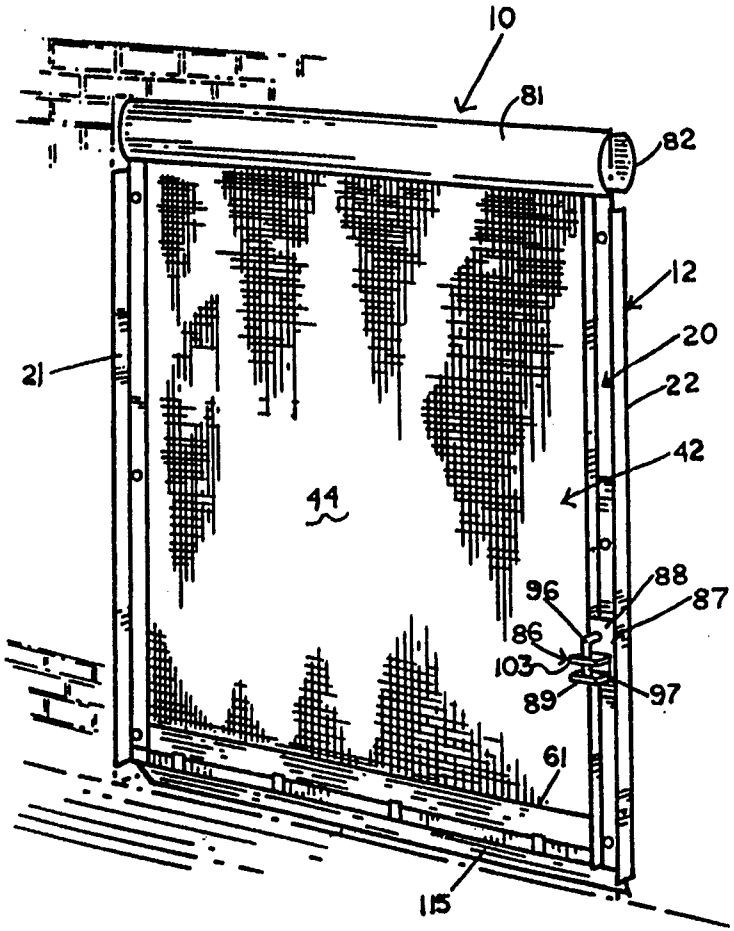
FIG. 2A is a perspective illustration of the door curtain assembly in its closed, locked position.
Figure 3:
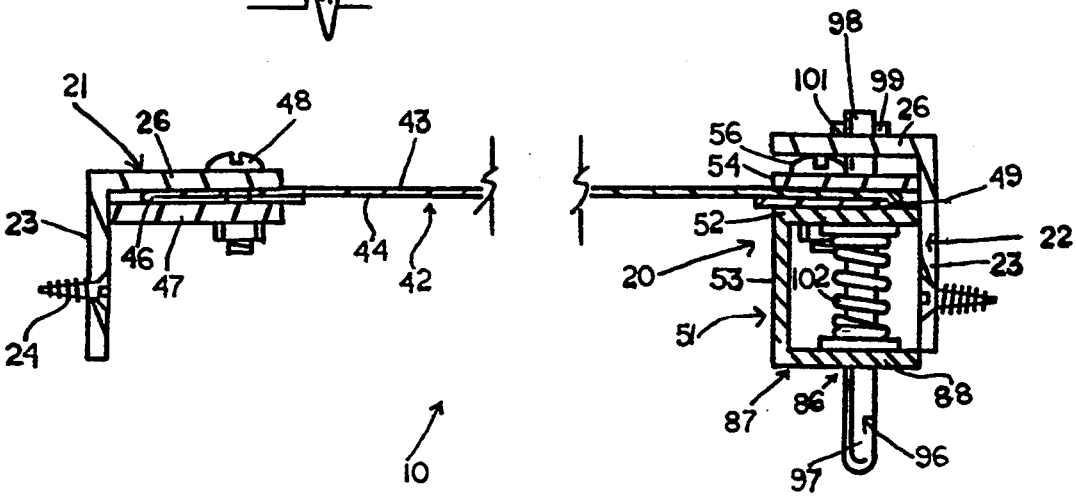
FIG. 3 is a top plan view of the door curtain, illustrating the attachment of the door curtain to the angle brackets of the framework.

As shown in FIGS. 1, 2A, and 2B, a door curtain 42 is mounted to the framework 20 of the door curtain assembly 10 and is movable across the span of the door opening 11 between an open position (FIG. 2B) and a closed position (FIG. 2A). The door curtain 42 generally is formed from a flexible, porous material such as a mesh or screen formed from a plastic or nylon material that permits light and air to readily pass therethrough, but which prevents the passage of insects, birds, and other pests, and people (when locked) through the door opening. Typically, the door curtain will be a bright, easily recognizable color such as yellow for safety, although other colors can be used if requested by purchaser. The fabric also can be treated with antibacterial and/or antimicrobial substances to repel insects and fungi such as mildew, etc. The door curtain is generally rectangularly shaped and generally ranges in sizes of between 8'–12' in width and 8'–12' in length or height, although it should be understood that the size of the door curtain is generally dependent upon the size of the doorway in which it is to be mounted. Thus, door curtains of various sizes can be used, according to the size of the doorway.

The door curtain 42 includes inwardly and outwardly facing surfaces 43 and 44 and a first side edge 46 along which a cover plate 47 is used to cover first side edge 46 after mountings to first angle bracket 21. The cover plate 47 is a substantially rectangularly shaped strip of metal, such as aluminum, of approximately the same width as the lateral portion 26 of the first angle bracket 21 (FIG. 1). As shown in FIG. 3, the first side edge 46 of the door curtain 42 is sandwiched between the cover plate and the lateral portion of the first angle bracket and the cover plate is attached to the lateral portion of the first angle bracket by fasteners 48 such as bolts, or similar means. As a result, the first side edge of the door curtain is securely attached to the first side 13 (FIG. 1) door jamb 12.

The door curtain 42 further includes a second or closure side edge 49 spaced from the first side edge 46. A curtain bracket 51 is positioned along the second side edge 49, on the inwardly facing side surface 43 of the door curtain. As shown in FIG. 3, the curtain bracket generally is an L-shaped angle bracket having a longitudinal portion 52 that is adapted to lie flat against the inwardly facing side surface of the door curtain, extending along the length of the second side edge 49 thereof, and a lateral portion 53 that projects away from the longitudinal portion 52 at a right angle thereto, extending partially along the length of the second side edge 49 of the door curtain. A mounting plate 54 is attached along the second side edge 49 along the outwardly facing side surface 44 of the door curtain, approximately aligned with the longitudinal portion 52 of the curtain bracket. The mounting plate generally is a strip of metal such as aluminum of a slightly smaller width and the same length as the longitudinal portion of the curtain bracket.

The second side edge of the door curtain is positioned between the mounting plate 54 and the longitudinal portion 52 of the curtain bracket 51, and fasteners 56, such as bolts or similar means are inserted through the mounting plate and longitudinal portion of the curtain bracket. As a result, the curtain bracket and mounting plate are attached to the door curtain along the second side edge thereof to stabilize the second side edge of the door curtain and provide a means for attaching the second side edge of the door curtain to the angle bracket 22 at the second side of the door Jamb.

As shown in FIG. 1, the door curtain 42 further includes a bottom edge 61 and a top edge 62. As shown in FIGS. 1 and 4, the top edge 62 is formed by the folding over of the upper portion of the door curtain, forming an overlapped portion (or header). A series of eyes 63 or similar connectors are mounted at spaced intervals therealong.

As FIGS. 1 and 4 illustrate, a curtain rod 66 is mounted between the first and second sides 13 and 14 (FIG. 1) of the door jamb 12 extending across the span of the door opening 11. The curtain rod 66 generally is a cylindrical rod or pipe formed from galvanized steel or a similar material and is of a length slightly less than the width of the door opening 11. Rod support brackets 67 and 68 are positioned along each of the first and second sides of the door jamb 12, mounted on the upper edges 27 of the lateral portions 26 of the first and second angle brackets 21 and 22. As FIG. 1 illustrates, each rod support bracket generally is an elongated substantially octagonally shaped box being formed from a metal such as aluminum, or similar material. A slot 69 is formed in the lower end 71 of each rod support bracket 67 and 68. The upper edges 27 of the lateral portions 26 of the first and second angle brackets of the framework are received within the slots 69 so as to mount the rod support brackets upon the upper ends of the angle brackets 21 and 22 with the rod support brackets supported thereby. The rod support brackets 67 and 68 are adjusted upwards by means of the slots until they are firm against the ends of the upper plate 29 between the two outside tracks 36, and are then firmly bolted in place. The rod support brackets thus support the ends of the upper plate 29. Rod holders 72 are mounted at the facing side surface 73 of each rod support bracket 67 and 68. The rod holders hold the curtain rod so as to mount the curtain rod in position spaced above the top edge of the door curtain.

A series of curtain hooks 76 (FIGS. 1 and 4) are placed along the length of the curtain rod and attached to the top edge 62 of the door curtain 42. As FIG. 4 illustrates, each curtain hook generally includes a lower U-shaped hook portion 77 that is received through an eye 63 mounted along the top edge of the door curtain, and has a substantially C-shaped upper portion 78 that is received over the curtain rod 66. Each curtain hook generally is formed from steel or a similar material and has a pair of rollers 79 typically formed from a nylon material positioned on the C-shaped upper portion 78. The rollers 79 engage and roll along the length of the curtain rod as the door curtain is moved in the direction of arrows A and A' (FIG. 2B) in order to open and close the door curtain across the door opening 11.

As FIG. 1 illustrates, valances 81 and 82 (shown in phantom) are mounted to the upper tracks 36 of upper plate 29, over the inwardly and outwardly facing side surfaces 43 and 44 of the door curtain 42. Each valance typically is formed from a plastic material such as a rigid polyvinyl chloride (PVC) or similar material and has a bowed or slightly curved configuration. As shown in FIG. 4, each valance has a substantially cylindrical connector 83 formed along its upper edge, which is received within a track 36 of the upper plate 29 so as to enable a limited range of pivotal movement of the valances. Each valance extends downwardly from the upper plate over the top edge 62 of the door curtain 42, curving inwardly toward the inwardly and outwardly facing side surfaces of the door curtain. The valances thus function as a means for covering and substantially sealing the space between the top edge of the door curtain and the upper plate 29 as shown in FIGS. 1, 2A, and 2B.

Figure 5:
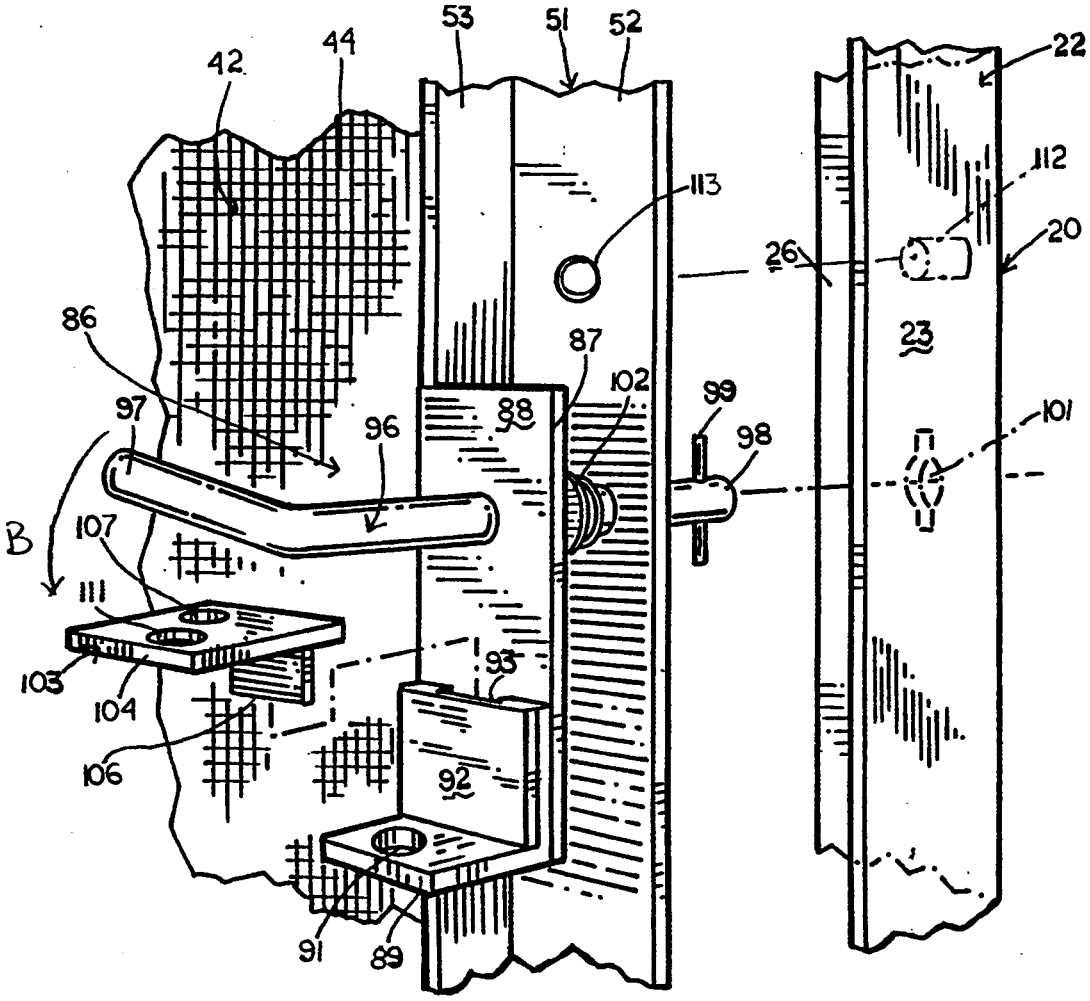
FIG. 5 is an exploded perspective view of the means for locking the door curtain assembly.
Figure 6:
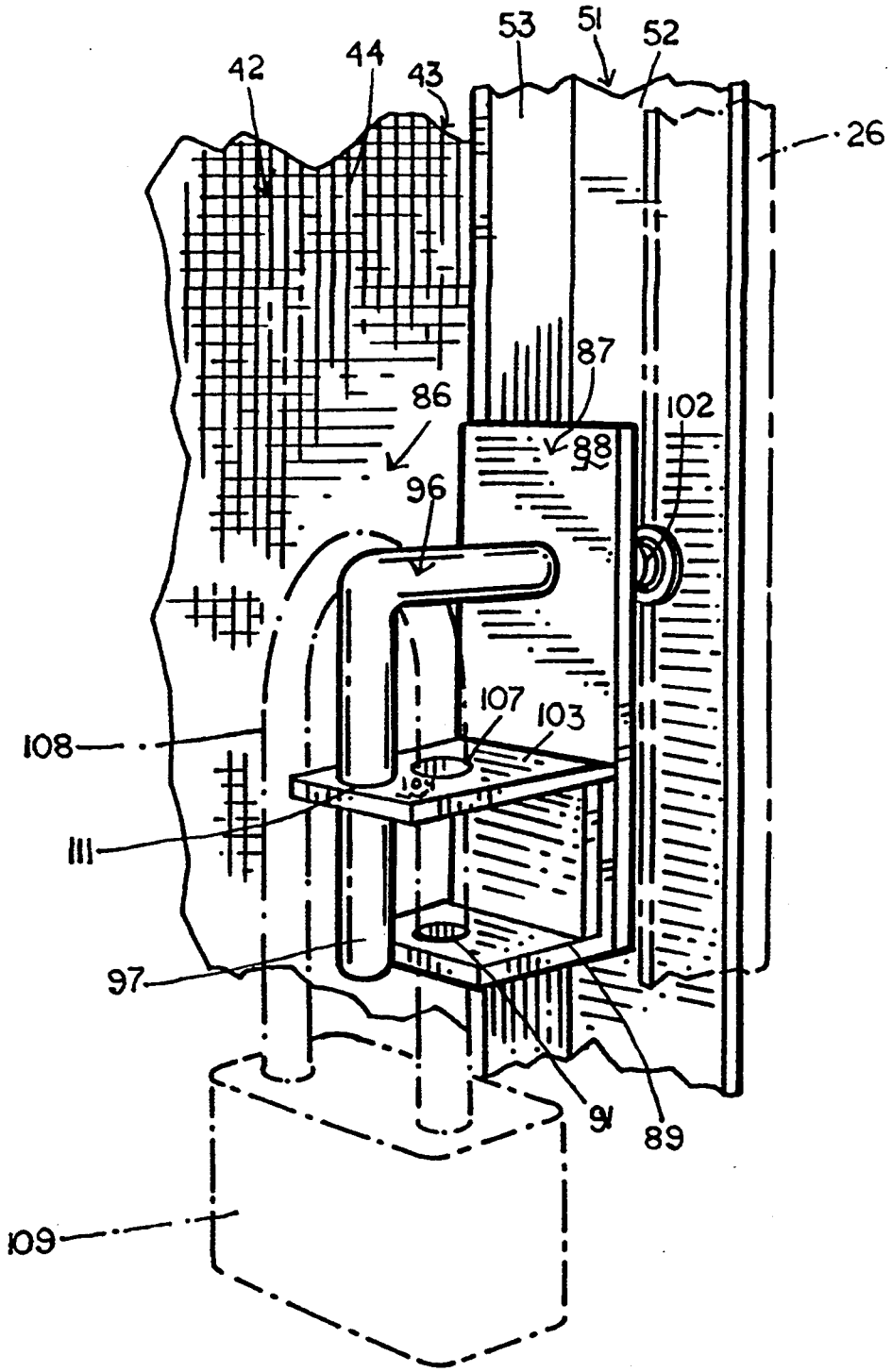
FIG. 6 is a perspective view of the means for locking the door curtain assembly.
Figure 7:
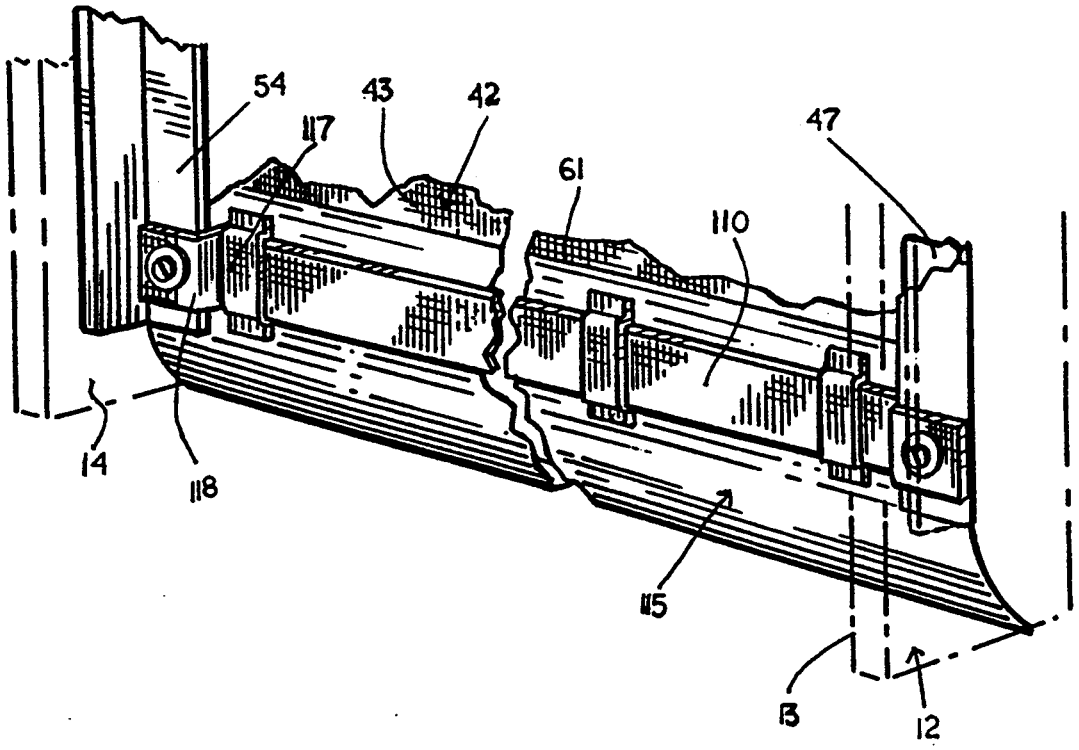
FIG. 7 is a perspective view of the sweep with optional security strap mounted to the bottom edge of the door curtain.

FIGS. 3, 5, and 6 illustrate a locking means 86 for the door curtain assembly mounted on the outwardly facing side surface 44 of the door curtain 42. As shown in Fig. 5, the locking means 86 includes a curtain locking plate 87 comprising a substantially L-shaped plate formed from aluminum or similar material and having a vertically extending portion 88 and a horizontally extending lower flange 89 projecting at a right angle from the vertical portion 88. A lock opening 91 is formed through the lower flange 89 adjacent its outermost edge. A substantially square shaped box or sleeve 92 is mounted at the junction between the lower flange 89 and the vertical portion 88 of the curtain lock plate 87, and extends partially along the length of the vertical portion 88. A slot 93 is formed in the sleeve 92 along its upper edge adjacent vertical portion 88, extending partially through the sleeve.

A door handle 96 is rotatably mounted to the curtain lock plate 87 and through the curtain bracket 51 at the second side edge of the door curtain. The handle includes a proximal end 97 that extends downwardly and is adapted to be gripped by the user, and a distal end 98 that projects through the curtain lock plate, curtain bracket, and mounting plate. A locking pin 99 projects through the distal end, extending perpendicular to the distal end, as shown in FIG. 5. As FIG. 5 illustrates, a locking bore 101 is formed through the longitudinal portion 23 of the second angle bracket 22, and has a configuration approximately sized and shaped to receive the distal end of the handle with the distal end in a prescribed orientation.

As the handle is turned, the distal end of the handle is rotated such that the locking pin becomes misaligned with the locking bore 101 formed in the longitudinal portion of the second angle bracket. In such an orientation, the handle is locked in place to secure the second side edge of the door curtain to the second angle bracket to lock the door curtain in its closed position illustrated in FIG. 2A. As shown in FIGS. 3 and 5, a tension spring 102 is mounted about the handle, positioned between the curtain lock plate 87 and the longitudinal portion 56 of curtain support bracket 51. The spring 102 serves to bias the handle so that the locking pin frictionally engages the rear surface of the second angle bracket to secure the handle in its locked position with the proximal end 97 of the handle extending downwardly as shown in FIG. 6.

A handle lock plate 103, formed from the same or a similar material as the curtain lock plate, is mountable to the curtain lock plate 87 as indicated in FIGS. 5 and 6. The handle lock plate 103 includes a horizontally oriented upper plate 104 that is of a length slightly longer than the lower flange 89 of the curtain lock plate, and a downwardly projecting tab 106 adapted to be received within the slot 93 of sleeve 92 to mount the handle lock plate to the curtain lock plate as shown in FIGS. 5 and 6. A lock opening 107 is formed through the upper plate 104 of handle lock plate 103. Lock opening 107 becomes aligned with lock opening 91 formed through the lower flange of the curtain lock plate when the handle lock plate is mounted to the curtain lock plate. The hasp 108 of a padlock 109 (shown in phantom) or a similar lock means thus can be inserted through the lock openings for locking the handle in its closed position. A handle bore 111 is also formed through the upper plate of the handle lock plate in a position such that the proximal end 97 of the handle 96 is received therethrough and thus is securely locked in place with the handle in its closed position (FIGS. 2A and 6).

As shown on FIG. 5, for ease of aligning locking pin 99 With lateral placed locking bore 101, an alignment pin 112 is mounted to the surface of the lateral portion 26 of angle bracket 22 facing the door curtain projecting therefrom from the lateral and is placed approximately 6 inches above locking bore 101. A guide bore 113 is positioned on the longitudinal portion 52 of the curtain bracket approximately 6 inches above the handle rod 96 approximately aligned with the alignment pin 112. The alignment pin is received through the guide bore to align the distal end of the handle with the locking bore to facilitate the closing and locking of the curtain.

As shown in FIGS. 1, 2A, 2B, and 7, a sweep 115 is mounted to the bottom edge 61 of the door curtain 42. The sweep 115 generally is a sheet of a flexible material such as a polyvinyl cloth or a similar material. The sweep extends downwardly from the bottom edge of the door curtain, a distance that is substantially greater than the distance between the bottom edge of the door curtain and the floor of the warehouse so that it overlaps and bears against the floor of the warehouse to create a friction seal at the bottom of the door curtain. A mounting strip 116 (FIG. 7) formed from a flexible material such as nylon is attached to the sweep 115 through loops or tabs 117 sewn to the sweep, and is attached at its ends to the first angle bracket 21 and the mounting plate 54 of the door curtain 42 by connectors 118. The flexibility of the mounting strap and the sweep enables the sweep to be compressed or folded as the door curtain is moved in the direction of arrows A (FIG. 2B) of the door curtain is opened, and has sufficient resiliency to enable the sweep to be stretched taut and to remain flat against the floor of the warehouse to create a tight friction seal at the bottom of the warehouse to prevent insects, pilfered objects, etc., from passing under the bottom edge of the door curtain.

INSTALLATION AND OPERATION

As illustrated in FIG. 1, the door curtain assembly 10 is installed in the door jamb 12 of a door opening 11 of a warehouse such as on a loading dock or similar area. First and second angle brackets 21 and 22 are mounted to the first and second sides 13 and 14, respectively, of the door jamb 12. The longitudinal portions 23 of the first and second angle brackets are placed flush against the first and second sides of the door jamb and fasteners. Fasteners 24 are inserted through the longitudinal portions 23 of the angle brackets to secure the angle brackets to the sides of the door jamb. Thereafter, an upper plate 29 is mounted to the header 16 by the insertion of fasteners 38 through mounting holes 37. The upper plate is positioned with its ends 31 and 32 abutting the first and second sides of the door jamb and spans the width of the door opening 11.

Thereafter, a curtain rod 66 is mounted within the doorway 11 adjacent the upper plate 29. A pair of rod support brackets 67 and 68 are mounted upon the upper edges 27 of the lateral portions 26 of the first and second angle brackets 21 and 22 of framework 20, with the upper edges 27 of the lateral portions received within slots 69 of the rod support brackets. The rod support brackets thus are removably mounted upon and are supported by the angle brackets without the need for screws, bolts, or other fastening means to attach the rod support brackets of the door jamb. Each of the rod support brackets includes rod holders 72 mounted to facing side surfaces 73 of the rod support brackets. The curtain rod 66 is mounted to the rod support brackets with its ends received within the rod holders 72. Curtain hooks are thereafter placed over the curtain rod 66, with a C-shaped upper portion 78 of the curtain hooks received over the curtain rod and rollers 79 of the curtain hooks engaging the curtain rod.

For some installations, the door curtain 42 is mounted to the framework during manufacture and thus is installed with the framework. However, for other installations, the door curtain can be installed after the framework is mounted in place. For such installations with the framework 20 of the door curtain assembly 10 previously installed, a door curtain of a size approximately corresponding to the size and shape of the door opening 11 is mounted to the framework 20. As shown in FIGS. 1 and 4, the U-shaped lower portions 77 of the curtain hooks 76 are received through eyes 63 affixed along the top edge 62 of the door curtain 42 so that the door curtain is suspended by the curtain hooks from curtain rods 66.

The first side edge 46 of the door curtain 42 is thereafter placed between a mounting plate 47 and the lateral portion 26 of the first angle bracket 21. The first side edge of the door curtain is sandwiched between mounting plate 47 and lateral portion 26 of the first angle bracket. Fasteners 48 are inserted through the cover plate 47 through the first side edge 46 of the door curtain, then through the lateral portion 26 of the first angle bracket to secure the first side edge of the door curtain to the first side 13 of the door jamb 12. A curtain bracket 51 is mounted to the second side edge 49 of the door curtain 42, with the second side edge of the door curtain positioned between a longitudinal portion 52 of the curtain bracket 51 and a mounting plate 54. The attachment of the mounting plate and curtain bracket serve to stabilize and provide rigidity to the second side edge 49 of the door curtain 42.

With the door curtain assembly 10 thus installed, the door curtain can be urged in the direction of arrows A' as shown in FIG. 2B to move the door curtain 42 into its closed, locked position, or can be moved in the direction of arrow A (2B) to move the door curtain to its open, unlocked position to permit access through the door opening into and out of the warehouse. Tie backs (not shown) are provided for retaining the curtain in its open position. If it is desired to close and lock the door curtain assembly 10, as shown in FIG. 2A, the door curtain assembly is urged in the direction of arrows A' (FIG. 2B), stretching the door curtain taut across the door opening 11 until the second side edge 49 of the door curtain 42 is in abutment with the second angle bracket 22 mounted to the second side 14 of the door jamb 12. To lock the door curtain 42 in its closed position, the handle 96 is rotated to its raised, unlocking position, as shown n FIG. 5, and the distal end 98 is urged through a locking bore 101 formed in the lateral portion 26 of the second angle bracket 22. The handle is then rotated in the direction of arrow B to move the handle into a locking position shown in FIG. 6.

As FIG. 6 illustrates, if desired, a handle lock plate 103 can be mounted to the proximal end 97 of the handle 96, with the proximal end of the handle received through a handle bore 111 formed through the handle lock plate and with the handle lock plate mounted to the curtain lock plate 87. The handle lock plate 103 further includes a lock opening 107, which becomes aligned with a lock opening 91 when the handle lock plate is positioned about the proximal end of the handle and the handle is in its locking position. The hasp 108 of a padlock 109 (shown in phantom) thereafter can be inserted through the aligned lock openings of the handle lock plate and the curtain lock plate to secure the handle in its closed, locked position shown in FIG. 6.

Valances 81 and 82 (FIGS. 1 and 4) are mounted to the upper plate 29 of the framework 20 by inserting the connector portions 83 formed along the upper edges of the valances 81 and 82 into the tracks or grooves 36 formed along the side edges 33 and 34 of the upper plate (FIGS. 1 and 4). The valances extend downwardly from the upper plate to a position slightly overlapping the top edge 62 of the door curtain 42. As a result, the valances thus serve to enclose and substantially seal the opening between the upper plate and the top edge of the door curtain to restrict access through this opening by insects, birds, and similar pests.

It should be understood by those skilled in the art that the present invention can be adapted for other uses than solely as a door curtain for a dock door opening. The present invention can also be used as a room divider for enclosing spaces or for partitioning off an area for storage or other use. Further, other types of fabric material such as non-porous vinyl fabrics or the like can also be used in place of the mesh material of the door curtain, as for example, when using the curtain to partition spaces or create a storage space within a warehouse.

While the present invention has been described in detail with reference to a preferred embodiment, it will be understood by those skilled in the art that numerous modifications, additions, and changes can be made thereto without departing from the spirit and scope of the invention as set forth in the following claims.

We claim:

1. A door assembly for warehouses for closing a dock door opening of the warehouse while permitting air passage through the dock door opening, comprising:

a door frame mounted about the dock door openings;

a door curtain of a size approximately equivalent to the dock door opening and having an upper portion, a first side portion mounted to said door frame along a first side of the dock door opening, and a second side portion adapted to engage a second side of the dock door opening for enclosing the dock door opening;

a curtain rod mounted to said door frame above said door curtain and extending across the dock door opening for supporting said door curtain within the dock door opening;

a curved, substantially rigid valance means for enclosing said curtain rod and said upper portion of said door curtain attached thereto, to retard egress through the dock door opening adjacent said upper portion of said door curtain by insects, mounted to an upper portion of said door frame and extending downwardly and toward said door curtain, engaging said door curtain so as to form a seal about said upper portion of said door curtain; and means for locking said door curtain across said dock door opening.

2. The door assembly of claim 1 and wherein said door curtain is formed from a mesh material that enables the passage of air therethrough but restricts the passage of insects therethrough.

3. The door assembly of claim 1 and wherein said door frame comprises a first angle bracket mounted along a first side of the dock door opening to which said door curtain is mounted, a second angle bracket mounted along a second side of the dock door opposite said first angle bracket, rod support brackets adapted to engage and be supported on said first and second angle brackets for supporting said curtain rod as well as a mounting plate positioned along a header of the dock door opening for mounting said valance means adjacent the upper edge of the dock door opening.

4. The door assembly of claim 1 and further comprising a sweep means mounted along a lower edge of said door curtain, extending downwardly therefrom and adapted to engage the dock floor surface to provide a seal along said lower edge of said door curtain.

5. The door assembly of claim 3 and wherein said means for locking said door curtain comprises a curtain lock plate mounted to said second side portion of said door curtain and having a lower flange having a lock opening formed therethrough, a handle means mounted to and extending through said curtain lock plate, to engage said second angle bracket for securing said second side portion of said door curtain to said angle bracket, and a handle lock plate adapted to be mountable to said curtain lock plate and having a lock opening approximately aligned with said lock opening of said curtain lock plate and a handle opening through which said handle means is received to secure said handle means in a locked position.

6. A door assembly for enclosing a door opening of a warehouse dock door or similar application, comprising:

a framework having a first support means mounted along a first side edge of the door opening, a second support means mounted along a second side of the door opening opposite said first support means and a mounting plate mounted along an upper edge of the door opening;

means for closing the door opening having a first side attached to said first support means and a second side adapted to releasibly engage said second support means to secure said means for closing in a closed position covering the door opening;

support rod mounted to said framework adjacent said upper mounting plate thereof and upon which said means for closing is movably mounted for supporting said means for closing; and lock assembly mounted to said second side of said means for covering and including a curtain lock plate mounted to said means for closing and having a lower flange projecting laterally therefrom and having a lock opening formed therethrough and a handle extending through said curtain lock plate and adapted to engage said second support means in locking engagement, and a handle lock plate adapted to attach to said curtain lock plate and having a lock opening that is approximately aligned with said lock opening of said curtain lock plate when said handle lock plate is attached to said curtain lock plate for receiving a lock means therethrough and a handle lock opening through which said handle is received for securing said handle in a locked position.

7. The door assembly of claim 6 and wherein said first and second support means each comprise an angle bracket having a longitudinal flange portion mounted to the side edge of the door opening and a lateral flange portion projecting therefrom.

8. The door assembly of claim 6 and further including valances each mounted to said upper mounting plate on opposite sides of said means for closing the door opening for covering said support rod and said upper mounting plate to retard egress through the dock door opening above said means for closing the door opening.

9. The door assembly of claim 6 and further comprising a sweep means mounted along a lower edge of said means for closing the door opening, extending downwardly therefrom and adapted to engage the dock floor surface to provide a seal along said lower edge of said means for closing the door opening.

10. The door assembly of claim 6 and wherein said means for closing the door opening comprises a curtain formed from a mesh material that enables the passage of air therethrough but restricts the passage of insects therethrough.

11. The door assembly of claim 10 and wherein said mesh material is formed of plastic.

12. The door assembly of claim 10 and wherein said mesh material comprises a fabric.

* * * * *